United States Patent [19]

Crawford

[11] 4,279,087

[45] Jul. 21, 1981

[54] BOX FRAME FOR FABRIC PRINTS AND THE LIKE

[76] Inventor: Andrew S. Crawford, 523 Sunset Rd., Ann Arbor, Mich. 48103

[21] Appl. No.: 36,479

[22] Filed: May 7, 1979

[51] Int. Cl.[3] ..... G09F 1/12

[52] U.S. Cl. ..... 40/158 R; 40/124.1; 40/603; 160/378

[58] Field of Search ..... 40/124.1, 539, 603, 40/155, 154, 152, 157, 152.1, 158 R; 229/33, 36; 160/378

[56] References Cited

U.S. PATENT DOCUMENTS

| | | | |
|---|---|---|---|
| 1,707,680 | 4/1929 | Norwood | 229/36 |
| 1,894,226 | 1/1933 | Ross | 229/36 |
| 2,728,449 | 12/1955 | Rheinfrank | 229/36 X |
| 3,559,316 | 2/1971 | Galper | 160/378 X |
| 3,787,992 | 1/1974 | Leonhardt | 40/152 |

*Primary Examiner*—John F. Pitrelli
*Attorney, Agent, or Firm*—Krass, Young & Schivley

[57] ABSTRACT

A box frame for the display of fabric prints and the like, comprising a shallow, closed box formed from folded sheet material, with the fabric stretched over the front face of the box and stapled or otherwise secured to the rear surface. The rear of the box is formed by overlying flap pairs extending inward from opposite sides of the box, each flap pair having flap tabs formed by folded down edges of the flaps, the tabs abutting each other and the inside front surface and extending across each other to stiffen the box. The tabs of the outer flap pair lock into slots formed in the underlying flap pairs to secure the flaps in the folded position. Slotted perforations are provided through flap pairs to enable ready wall mounting of the box frame.

8 Claims, 6 Drawing Figures

BOX FRAME FOR FABRIC PRINTS AND THE LIKE

BACKGROUND DISCUSSION

This invention concerns mounting arrangements or frames for securement of textile articles such as fabric prints and the like for display purposes, which are adapted to mount fabric articles by the articles being stretched over the frame and secured thereto.

The usual approach for the mounting of relatively lightweight fabric articles such as fabric prints is to stretch the same over a frame and secure the edges of the fabric articles to the reverse surface of the frame by stapling or by other suitable securement in order that the fabric may be maintained in a taut condition.

Difficulties have been encountered in providing an entirely satisfactory frame for such applications. A common frame design consists of mitered wood pieces assembled into a rectangular or square frame, with the fabric being stretched thereover and stapled onto the reverse surface of the wooden members.

Such frames often are constructed of relatively low grade wood in order to minimize the expense and cost of construction and such members have a tendency to warp, especially when constructed of relatively lightweight framing members. In addition, the relatively rough edges of the wood frame members have a tendency to catch and snap the fabric material.

If the framing members are made heavier or a solid member substituted for an open frame in an effort to avoid warping of the frame, the weight and cost of the frame increases accordingly. Also, the tendency to warp is not entirely corrected.

The tendency for warping of the open frame may be increased by the tension exerted by the fabric article being stretched on the frame if such is significant. Any tendency to warp produces an unaesthetic effect due to the development of folds, sags or wrinkles in the displayed fabric articles.

The use of narrow framing members also limits the mounting area to which the fabric may be stapled during the stretch installation of the fabric.

The use of an open frame may also preclude the use of wall mounting hangers which can be attached to the rear surface of an open frame since more or less the entire width of the framing members is required for securement of the fabric. The usual method is to merely hook the inside rear edge with the wall fasteners, a somewhat precarious method.

The open frame also precludes the use of selling labels secured to the rear surface. This represents a substantial disadvantage in retail merchandising operations.

The open frame also renders the fabric material unsupported and thus vulnerable to stretching and puncturing during handling, particularly in the retail store.

Accordingly, it is an object of the present invention to provide a mounting arrangement or frame for such articles as fabric prints and the like which may be provided at relatively low cost and which have a minimal tendency to warp.

It is a further object of the present invention to provide such a frame which is light in weight and which affords very convenient mounting of the fabric to the frame.

It is yet another object of the present invention to provide such a frame which may be readily and conveniently assembled and which is very easily installed on a mounting surface without the need for separate mounting hardware mounted to the frame.

It is still another object of the present invention to provide a frame for fabrics which affords a rear surface for the mounting of selling labels.

It is a further object of the present invention to provide a mounting which supports the fabric so as to reduce its vulnerability to puncture and stretch.

SUMMARY OF THE INVENTION

These and other objects of the present invention, which will become apparent upon a reading of the following specification and claims, are achieved by constructing a mounting frame, a hollow closed body in the preferred embodiment, from a blank of stiff sheet material such as cardboard or the like folded into a shallow, closed polygonal box, with the fabric article stretched over a smooth front surface of the box and stapled or otherwise secured to the rear of the box.

The box is formed of overlying inner and outer flap pairs, each extending inwardly from opposite sides of the box to orthogonally orient the flap pairs with respect to each other. Each of the flaps terminate with inwardly folded flap tabs which are dimensioned to extend the full depth of the box. The flap pairs are locked in the folded position by an interlock arrangement, in which the tabs of the outer flap pair are held in position in corresponding slotted openings formed in the inner flap pair which accommodates the tabs.

The abutting tab pairs extend in a crossing pattern to each other and act as reinforcing stiffener ribs for the box structure and the frontal mounting surface, while the abutment of the tabs adds further rigidity to the box frame.

The resulting closed and secured box structure resists warping and is relatively rigid, while being extremely lightweight and low in cost to manufacture. The cardboard material accepts stapling of the fabric item which may be secured anywhere on the rear surface of the box, which also serves as a mounting surface for selling labels. The solid support of the fabric reduces the incidence of damage due to puncture and stretch.

Aligned slotted perforations formed in the box flaps provide convenient mounting openings for installing the mounted fabric and box frame onto a wall surface.

The inside faces of the frame blank are prescored to produce ready folding of the sheet material along the box sides, and the flap and tab hinge points to enable ready assembly by folding of the blanks into the box frame.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The concept according to the present invention consists of the provision of a hollow closed body constituting the frame member to which the fabric is to be affixed. The hollow body is formed of a material such as to enable the fabric article to be readily attached thereto. The hollow closed body produces a degree of rigidity and resistance to warpage which is not afforded by either an open frame or a solid member, and while at the same time, being lighter in weight.

Figure 1:
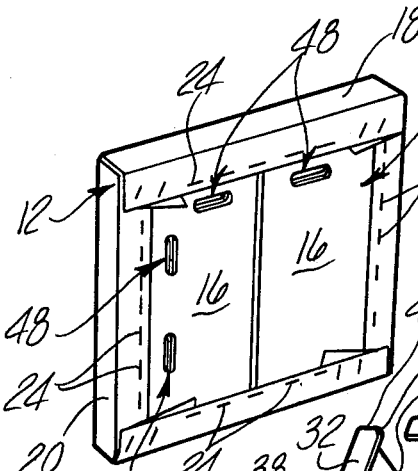
FIG. 1 is a perspective rear view of a box frame according to the present invention depicting a fabric print mounted thereto.
Figure 4:
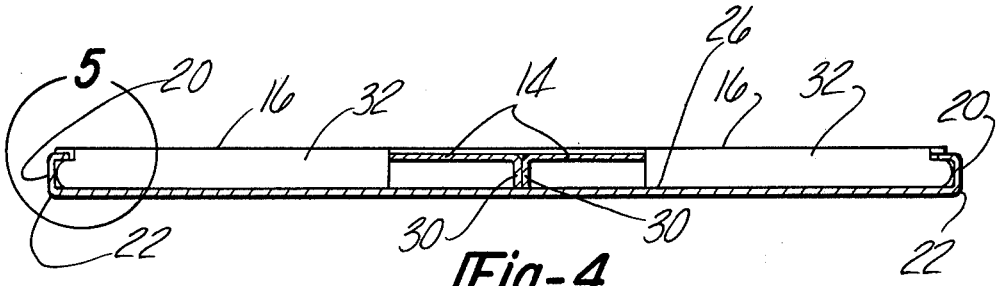
FIG. 4 is a view of section 4—4 taken in FIG. 3.

In the preferred embodiment of this concept, which is depicted in the drawings, a frame is created by a folding of a sheet blank of a suitably stiff and lightweight material such as corrugated cardboard into a shallow closed polygonal box frame generally indicated at 10 in FIG. 1. The box frame 10 is formed with a smooth front surface 12 (FIG. 4) created by a folding to the rear of inner and outer pairs of flaps 14 and 16. The fabric article 18 is stretched over the front surface 12 around the frame sides 20 and stapled to the rear surface constituted by the outer face of the outermost flap 16.

In so doing, the edges 22 formed by the folds present a relatively smooth rounded surface which is not apt to cause snagging or catching of the material of the fabric article 18.

Figure 5:
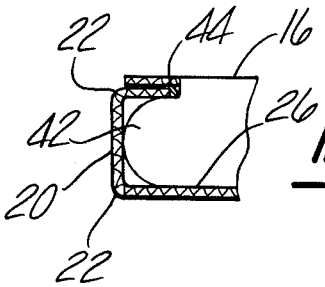
FIG. 5 is an enlarged view of the section 5—5 taken in FIG. 4.
Figure 6:
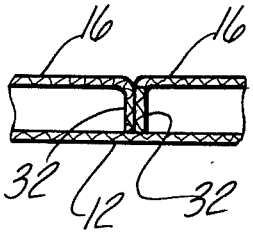
FIG. 6 is an enlarged view of the section 6—6 taken in FIG. 3.

As noted, the box frame 10 is preferably constructed of a paperboard material such as corrugated cardboard, depicted in FIGS. 5 and 6, such that the fabric article may be readily stapled as indicated at 24 directly thereto, securing it in the stretched, taut position on the box frame 10.

Figure 2:
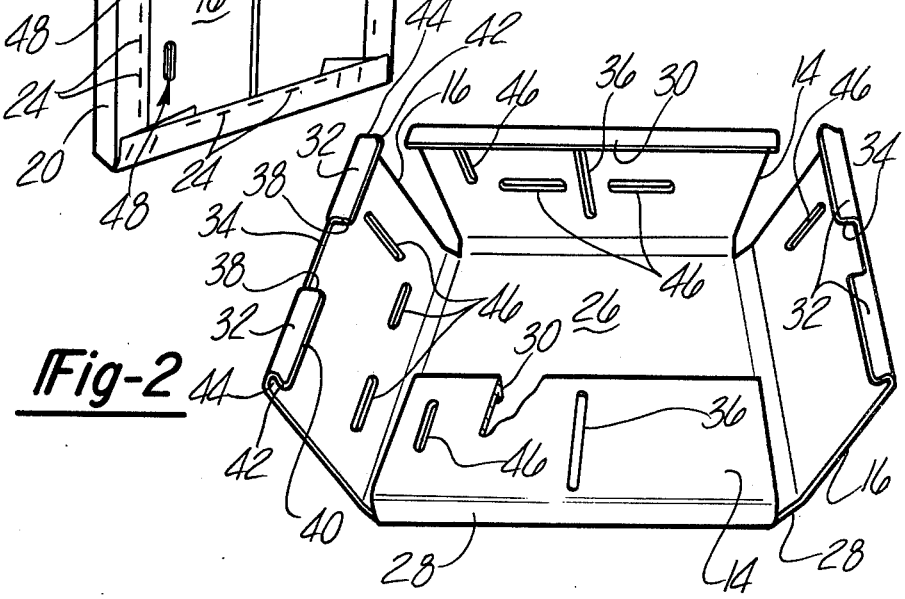
FIG. 2 is a rear perspective view of the box frame blank according to the present invention shown with the flap pairs partially folded together.

As best seen in FIG. 2, the box frame 10 is formed from a flat blank of sheet material which has been precut as by die cutting such as to be readily folded into the box frame 10 depicted in FIG. 1. This shape includes the oppositely extending rectangular inner flaps 14 and outer flaps 16, each contiguous to and extending out from the sides of a central, planar square or rectangular region indicated at 26, the outer surface of which provides a smooth front mounting surface 12 of the box frame 10.

Immediately adjacent each of the inner and outer corresponding flaps 14 and 16 are regions 28 intermediate parallel scorings 17 which form the frame sides 20 upon folding of the flaps 14 and 16. These scorings 17 can be achieved by die cutting in the same way that the blank is cut, with a partial penetration of the inside facing of the corrugated cardboard material in a manner well known to those skilled in the art.

The inner flaps 14 are provided with flap tabs 30 which are adapted to be folded along the full width of the terminal portions of the flaps 14 by a similar prescoring of the inside face.

The outer flaps 16 are provided with spaced tabs 32 formed by a similar prescoring extending along the width of the terminal portions of the flaps 16 and a central relief area 34. The depth of the flap tabs 30 and 32 correspond to the inside dimension of the box frame sides 20 such as to fully occupy the interior of the folded box frame 10 when the flaps 14 and 16 have been folded down into position.

The tabs 30 and 32 thus act as cross rib stiffeners. The orthogonally related tabs 30 and 32 cross each other and extend normally to the plane of the central region 26 or outer region to provide an interior stiffening effect supporting the front surface 12 and resisting bending of the box frame about either orthogonal axis.

Figure 3:
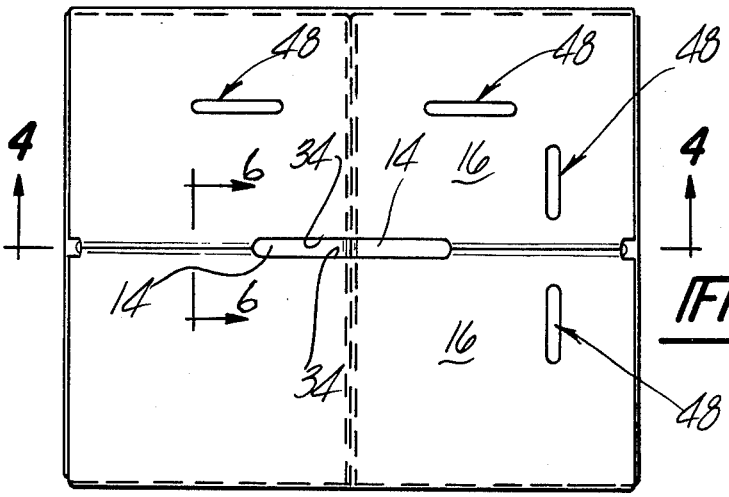
FIG. 3 is a rear elevational view of the box frame depicted in FIGS. 1 and 2.

The box is formed by folding the flaps 14 downward into position with tabs 30 folded into contact with the interior surface of the central region 26. The opposite outside faces of the tabs 30 come into abutment with each other as indicated in FIG. 3, which abutment enables both inner and outer flaps to resist bending of the box frame 10 about either major axis to further enhance the rigidity of the box frame 10.

The outer flaps 16 are then folded down into position with the tabs 32 inserted into precut openings 36, which extend at right angles to the flap tabs 30 and extend for the partial width of the flaps 14. The central relief area 34 and length of the tabs 32 are such that the tabs will enter each of the precut openings 36 and form an interlocking engagement, securing all of the flaps in the folded down position.

Each of the flap tabs 32 has a straight edge 38 extending at right angles to the lower edge 40, while the opposite outside edge is formed with a protuberance 42 and a relieved area 44. The tab 32 is forced into precut opening 36, with protuberance 42 forced past the end of the precut opening 36. After insertion, the straight edge 38 bearing against the opposite end insures that the tab 32 will be retained within the precut opening 36 due to the length of precut opening 36 being less than the length of the tab 32 as measured between the outermost point of the protuberance 42 and the straight edge 38.

In order to provide openings for wall mounting of the box frame 10, pairs of elongated perforations 46 are formed in each of the flaps 14 and 16, which, upon folding down of the flaps, provides pairs of elongated trough openings 48 extending along two sides of the box frame 10. This enables mounting of the box frame 10 with either side up and down by simply inserting the wall fasteners such as nails into the openings 48. The elongation of the openings 48 provides for easy alignment for the fasteners with the openings 48 and also for adjustment in the lateral positioning of the box frame 10 on the wall or other mounting surface.

It can be appreciated that the tight abutment of the opposing faces of the respective tabs 30 and 32 produces an effective closing of the hollow body constituted by the box frame 10, in that bending of the box frame 10 as a whole across either orthogonal axis of the frame is resisted by the opposing flaps 14 or 16 depending on the direction of the torsional bending force.

In addition, the tabs 30 and 32 extend at right angles of substantially the entire width and length of the box frame, as well as the depth thereof. The tabs 30 and 32 thus act as reinforcing ribs for reinforcing the central region 26.

This closed body or box frame is secured without the necessity for fasteners for securing the flaps together since the abutment in the tabs and the interlocking of the outer flaps 16 with the inner flaps 14 yields a relatively rigid but extremely lightweight structure which also may be fabricated easily and at relatively low cost. The fabric article 18 is easily secured to the folded box frame 10 by merely stapling the edges of the material stretched across the back surface of the box frame 10, the cardboard material accepting the staples and, with the lateral tension of the fabric article 18, the staples are thus maintained in position. The back surface also affords a mounting location for the selling labels, while the front surface supports the fabric article 18 to reduce its vulnerability to puncture and stretch.

The openings 48 provide convenient mounting of the completed mounted textile print and frame without the need for fasteners other than the wall fasteners to which the frame is secured and supported.

It will be appreciated that many variations in the described embodiment are of course possible. The hollow body constituted by the box frame 10 may of course be produced by other methods than folding of the sheet material as in the described embodiment of the present invention. The sheet material may be of any suitable foldable material for this particular embodiment other than the corrugated cardboard which is preferred since it is relatively low in cost and is rigid, while being lightweight and able to accept staple fasteners.

Similarly, the term "box frame," while often being constituted by a square or rectangular shape, may be of other shape for a particular application, i.e., triangular, hexagonal, or other polygonal shape.

The particular manner of securing the folded sheet material in the closed box configuration may also take many forms, although the described embodiment has many advantages as discussed in detail above, i.e., the box could be constructed with the use of fasteners rather than abutted tabs and interlocks, although this approach would increase the cost of the frame.

It can also be seen that the above specification describes a method of mounting a fabric article such as a fabric print onto a stretched frame, i.e., by stretching the fabric across the surface of a hollow closed body and around the edges of the hollow body, and securing the edges to the rear surface thereof to maintain the fabric article in a stretched condition on the frame.

The embodiments of the invention in which an exclusive property or privilege is claimed are defined as follows:

1. Display apparatus for providing a rigid mounting for display of flexible material items such as fabric prints and the like, said apparatus comprising:

a closed three-dimensional polygonal box formed of folded sheet material, said closed polygonal box including a front surface area formed by the outer surface of a central region of said sheet material;

a corresponding number of box sides extending rearwardly of said front surface formed by portions of said sheet material folded together away from said central region;

oppositely extending flap pairs formed by sections of said sheet material contiguous to said folded box sides and folded to extend toward each other and spaced from said central region, at least one flap pair including flap tabs consisting of inwardly bent folded portions of each of said flaps of sufficient depth and length to engage substantially the full width of the inside of said central region parallel to said sides, said flaps being of a length to position said flap tabs on opposite flaps in abutment with their outer juxtaposed surfaces;

means for securing said flaps and flap tabs in their respective folded positions; and flexible material being stretched over the front surface of said central region and attached to the flap pairs on the rear of the box whereby to provide a display in combination with the three-dimensional box which serves as an integral rigid support for the material.

2. The display apparatus according to claim 1 wherein said box is formed in a rectangular shape and is provided with two of said flap pairs extending normally to each other, each flap pair including said flap tab portions whereby said crossing pattern of said abutting flap tabs extends at right angles to each other to stiffen said box frame structure.

3. The display apparatus according to claim 1 wherein one of said flap pairs underlies the other of said flap pairs and wherein each of said outer flap tabs extends inwardly through slots formed in each of said inner flap pairs, said slots extending to be a length less than the length of said inner flap pairs.

4. The display apparatus according to claim 3 wherein said means securing said flap pairs in said folded position comprises a protuberance formed on each of said outer flap tabs adapted to interlock with said slot openings in said inner flap pairs to provide said means holding said flap pairs in the folded position.

5. The display apparatus according to claim 1 wherein said at least one flap pair is provided with orthogonally extending slotted openings extending through said flaps, whereby said box frame may be mounted to the wall surface by positioning wall fasteners in either of said slotted openings.

6. The display apparatus according to claim 1 wherein said folded sheet material consists of paperboard

7. The display apparatus according to claim 4 wherein both of said flap pairs are formed with slotted openings extending in orthogonal directions to each other, which slotted openings are aligned with said flap pairs in said folded position, whereby said box frame may be mounted to a wall surface by wall fasteners extending into said aligned slotted openings in said flap pairs.

8. The display apparatus according to claim 6 wherein said paperboard comprises corrugated cardboard.

* * * * *